US009574796B2

(12) United States Patent
Kempiak

(10) Patent No.: US 9,574,796 B2
(45) Date of Patent: Feb. 21, 2017

(54) ELECTROCHEMICAL REFRIGERATION SYSTEMS AND APPLIANCES

(71) Applicant: General Electric Company, Schenectady, NY (US)

(72) Inventor: Michael John Kempiak, Osceola, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 263 days.

(21) Appl. No.: 14/589,239

(22) Filed: Jan. 5, 2015

(65) Prior Publication Data

US 2016/0195308 A1 Jul. 7, 2016

(51) Int. Cl.
*F25B 1/00* (2006.01)

(52) U.S. Cl.
CPC ..... *F25B 1/00* (2013.01)

(58) Field of Classification Search
CPC ..... F25B 1/005; F25B 2341/0662; F25B 2400/071; H01M 8/00
See application file for complete search history.

(56) References Cited

U.S. PATENT DOCUMENTS 4,593,534 A 6/1986 Bloomfield
5,024,060 A 6/1991 Trusch
6,167,721 B1 1/2001 Tsenter
6,321,561 B1 * 11/2001 Maget ..... F03G 7/005 417/379
6,553,771 B2 4/2003 Tsenter
8,769,972 B2 7/2014 Bahar
2004/0142215 A1 * 7/2004 Barbir ..... H01M 8/04089 429/411
2010/0132386 A1 * 6/2010 Bahar ..... F25B 1/00 62/115
2010/0199715 A1 * 8/2010 Lifson ..... F25B 40/00 62/510
2011/0100040 A1 * 5/2011 Bush ..... F25B 1/10 62/149

FOREIGN PATENT DOCUMENTS

WO WO 2014/115555 A1 7/2014

* cited by examiner

*Primary Examiner* — Emmanuel Duke
(74) *Attorney, Agent, or Firm* — Dority & Manning, P.A.

(57) ABSTRACT

Refrigeration systems and appliances are provided. A refrigeration system includes a refrigerant, the refrigerant including a working fluid and an electrochemically active fluid. The refrigeration system further includes a condenser, an evaporator, and an electrochemical compressor in fluid communication with the condenser and the evaporator. The refrigeration system can further include various components which advantageously reduce the energy consumption and increase the predicatability and efficiency of the refrigeration system.

20 Claims, 11 Drawing Sheets

ELECTROCHEMICAL REFRIGERATION SYSTEMS AND APPLIANCES

FIELD OF THE INVENTION

The present disclosure relates generally to electrochemical refrigeration systems, i.e. refrigeration systems that utilize electrochemical compressors, and to appliance which utilize such refrigeration systems.

BACKGROUND OF THE INVENTION

Various types of refrigeration systems are utilized in a variety of settings for a variety of purposes, including for example cooling chambers of appliances. For example, refrigeration systems are utilized in water heaters such as heat pump water heaters, and to cool fresh food chambers and freezer chambers of refrigerator appliances. In general, a refrigeration system removes heat from a heat source and rejects that heat to a heat sink. While many thermodynamic effects have been exploited in the development of refrigeration systems, one of the most popular today utilizes the vapor compression approach. This approach is sometimes called mechanical refrigeration because a mechanical compressor is used in the cycle.

However, the vapor compression approach to a refrigeration system has disadvantages. For example, mechanical compressors can account for a significant portion of a household's energy consumption. Any improvement in efficiency related to compressor performance can have significant benefits in terms of energy savings and thus have significant positive environmental impact.

Accordingly, electrochemical refrigeration systems, which utilize electrochemical compressors, have recently been developed. Electrochemical compressors generally utilize electrochemical cells for compression purposes, and are typically more efficient that mechanical compressors. However, presently known electrochemical refrigeration systems can also have disadvantages. For example, the refrigerant utilized in an electrochemical refrigeration system typically includes a working fluid and an electrochemically active fluid. The energy required to move both components of the refrigerant within the system is relatively significant, with a significant amount of this energy wasted relative to the amount of work produced. Further, during expansion of the refrigerant in a typical electrochemical refrigeration cycle, the behavior of the electrochemically active fluid can be difficult to predict and control.

Accordingly, improved refrigeration systems are desired in the art. In particular, more efficient and predictable electrochemical refrigeration systems would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a refrigeration system is provided. The refrigeration system includes a refrigerant, the refrigerant including a working fluid and an electrochemically active fluid. The refrigeration system further includes a condenser, an evaporator, and an electrochemical compressor in fluid communication with the condenser and the evaporator, the electrochemical compressor including a housing and an electrochemical cell disposed within the housing. The refrigeration system further includes a phase separator in fluid communication with the condenser and the evaporator and disposed downstream of the condenser, the phase separator including an inlet, a first outlet and a second outlet, the first outlet configured to exhaust the working fluid, the second outlet configured to exhaust the electrochemically active fluid. The working fluid exhausted from the first outlet is flowed through the evaporator and the electrochemically active fluid exhausted from the second outlet bypasses the evaporator.

In accordance with another embodiment, an appliance is provided. The appliance includes a housing defining a compartment, and a refrigeration system in communication with the compartment for heating or cooling the compartment. The refrigeration system includes a refrigerant, the refrigerant including a working fluid and an electrochemically active fluid. The refrigeration system further includes a condenser, an evaporator, and an electrochemical compressor in fluid communication with the condenser and the evaporator, the electrochemical compressor including a housing and an electrochemical cell disposed within the housing. The refrigeration system further includes a phase separator in fluid communication with the condenser and the evaporator and disposed downstream of the condenser, the phase separator including an inlet, a first outlet and a second outlet, the first outlet configured to exhaust the working fluid, the second outlet configured to exhaust the electrochemically active fluid. The working fluid exhausted from the first outlet is flowed through the evaporator and the electrochemically active fluid exhausted from the second outlet bypasses the evaporator.

In accordance with another embodiment, a refrigeration system is provided. The refrigeration system includes a refrigerant, the refrigerant including a working fluid and an electrochemically active fluid. The refrigeration system further includes a condenser, an evaporator, and an electrochemical compressor in fluid communication with the condenser and the evaporator, the electrochemical compressor including a housing and an electrochemical cell disposed within the housing. The refrigeration system further includes a phase separator in fluid communication with the condenser and the evaporator and disposed downstream of the condenser. The phase separator includes an inlet, a first outlet and a second outlet, the first outlet configured to exhaust the working fluid, the second outlet configured to exhaust the electrochemically active fluid. The working fluid exhausted from the first outlet is flowed through the evaporator and the electrochemically active fluid exhausted from the second outlet bypasses the evaporator. The refrigeration system further includes an energy recovery cell. The electrochemically active fluid exhausted from the second outlet is in fluid communication with the energy recovery cell and is combined with the working fluid exhausted from the first outlet downstream of the energy recovery cell.

In accordance with another embodiment, an appliance is provided. The appliance includes a housing defining a compartment, and a refrigeration system in communication with the compartment for heating or cooling the compartment. The refrigeration system includes a refrigerant, the refrigerant including a working fluid and an electrochemically active fluid. The refrigeration system further includes a condenser, an evaporator, and an electrochemical compressor in fluid communication with the condenser and the evaporator, the electrochemical compressor including a housing and an electrochemical cell disposed within the housing. The refrigeration system further includes a phase separator in fluid communication with the condenser and the evaporator and disposed downstream of the condenser. The phase separator includes an inlet, a first outlet and a second outlet, the first outlet configured to exhaust the working fluid, the second outlet configured to exhaust the electrochemically active fluid. The working fluid exhausted from the first outlet is flowed through the evaporator and the electrochemically active fluid exhausted from the second outlet bypasses the evaporator. The refrigeration system further includes an energy recovery cell. The electrochemically active fluid exhausted from the second outlet is in fluid communication with the energy recovery cell and is combined with the working fluid exhausted from the first outlet downstream of the energy recovery cell.

In accordance with another embodiment, a refrigeration system is provided. The refrigeration system includes a refrigerant, the refrigerant including a working fluid and an electrochemically active fluid. The refrigeration system further includes a condenser, an evaporator, and an electrochemical compressor in fluid communication with the condenser and the evaporator, the electrochemical compressor including a housing, a first electrochemical cell disposed within the housing, a second electrochemical cell disposed within the housing downstream of the first electrochemical cell, and a conduit extending between and in fluid communication with the first electrochemical cell and the second electrochemical cell. At least a portion of the conduit extends peripherally about and proximate to the housing. The refrigerant flows from the first electrochemical cell through the conduit to the second electrochemical cell.

In accordance with another embodiment, an appliance is provided. The appliance includes a housing defining a compartment, and a refrigeration system in communication with the compartment for heating or cooling the compartment. The refrigeration system includes a refrigerant, the refrigerant including a working fluid and an electrochemically active fluid. The refrigeration system further includes a condenser, an evaporator, and an electrochemical compressor in fluid communication with the condenser and the evaporator, the electrochemical compressor including a housing, a first electrochemical cell disposed within the housing, a second electrochemical cell disposed within the housing downstream of the first electrochemical cell, and a conduit extending between and in fluid communication with the first electrochemical cell and the second electrochemical cell. At least a portion of the conduit extends peripherally about and proximate to the housing. The refrigerant flows from the first electrochemical cell through the conduit to the second electrochemical cell.

In accordance with another embodiment, a refrigeration system is provided. The refrigeration system includes a refrigerant, the refrigerant including a working fluid and an electrochemically active fluid. The refrigeration system further includes a condenser, an evaporator, and an electrochemical compressor in fluid communication with the condenser and the evaporator, the electrochemical compressor including a housing, a first electrochemical cell disposed within the housing, and a second electrochemical cell disposed within the housing. The refrigeration system further includes a first phase separator in fluid communication with and disposed downstream of the condenser, the first phase separator including an inlet, a first outlet and a second outlet, the first outlet configured to exhaust the working fluid, the second outlet configured to exhaust the electrochemically active fluid, wherein the electrochemically active fluid exhausted from the second outlet bypasses the evaporator. The refrigeration system further includes a second phase separator in fluid communication with and disposed downstream of the first outlet of the first phase separator, the second phase separator including an inlet, a first outlet and a second outlet, the first outlet configured to exhaust a liquid portion of the working fluid, the second outlet configured to exhaust a gaseous portion of the working fluid, wherein the gaseous portion exhausted from the second outlet bypasses the evaporator. The working fluid exhausted from the first outlet of the second phase separator is flowed through the evaporator.

In accordance with another embodiment, an appliance is provided. The appliance includes a housing defining a compartment, and a refrigeration system in communication with the compartment for heating or cooling the compartment. The refrigeration system includes a refrigerant, the refrigerant including a working fluid and an electrochemically active fluid. The refrigeration system further includes a condenser, an evaporator, and an electrochemical compressor in fluid communication with the condenser and the evaporator, the electrochemical compressor including a housing, a first electrochemical cell disposed within the housing, and a second electrochemical cell disposed within the housing. The refrigeration system further includes a first phase separator in fluid communication with and disposed downstream of the condenser, the first phase separator including an inlet, a first outlet and a second outlet, the first outlet configured to exhaust the working fluid, the second outlet configured to exhaust the electrochemically active fluid, wherein the electrochemically active fluid exhausted from the second outlet bypasses the evaporator. The refrigeration system further includes a second phase separator in fluid communication with and disposed downstream of the first outlet of the first phase separator, the second phase separator including an inlet, a first outlet and a second outlet, the first outlet configured to exhaust a liquid portion of the working fluid, the second outlet configured to exhaust a gaseous portion of the working fluid, wherein the gaseous portion exhausted from the second outlet bypasses the evaporator. The working fluid exhausted from the first outlet of the second phase separator is flowed through the evaporator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
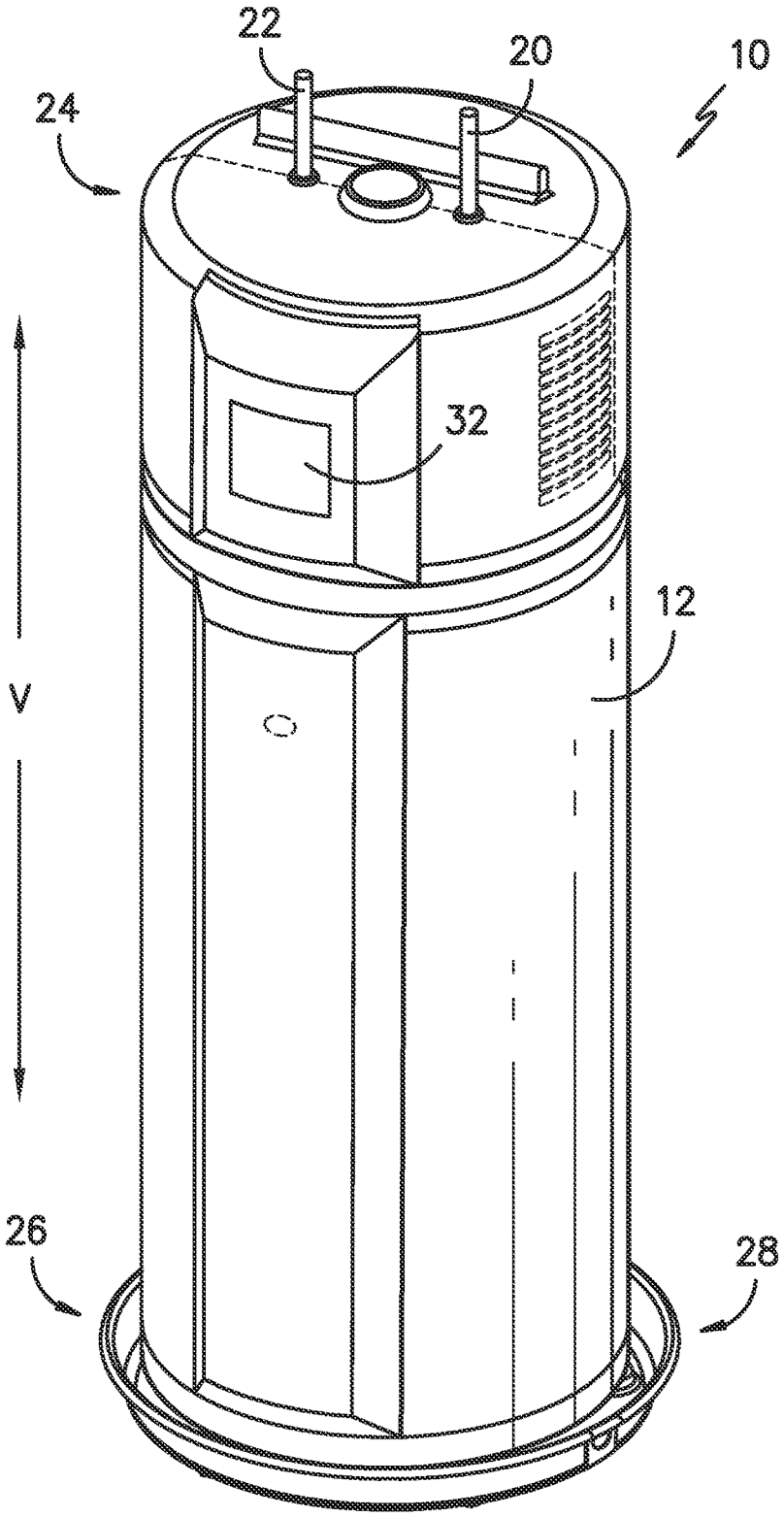
FIG. 1 is a perspective view of an appliance (in this case a water heater) in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 and illustrate an appliance in accordance with one embodiment of the present disclosure, in this case a water heater 10. It should be understood, however, that the present disclosure is not limited to water heaters, and rather that any suitable appliances which utilize refrigeration systems and corresponding refrigeration cycles, including for example refrigerators, are within the scope and spirit of the present disclosure.

Water heater 10 includes a casing 12. A tank or housing 14 is positioned within casing 12. The housing defines a compartment 16 in which water is held and heated. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

Water heater 10 also includes a cold water conduit 20 and a hot water conduit 22 that are both in fluid communication with compartment 16. As an example, cold water from a water source, e.g., a municipal water supply or a well, can enter water heater 10 through cold water conduit 20 (shown schematically with arrow labeled $F_{cool}$ in FIG. 2). From cold water conduit 20, such cold water can enter compartment 16 wherein it is heated via a heat pump/refrigeration system to generate heated water. Such heated water can exit water heater 10 at hot water conduit 22 (shown schematically with arrow labeled $F_{hot}$ in FIG. 2) and, e.g., be supplied to a bath, shower, sink, or any other suitable feature.

Water heater 10 extends longitudinally between a top portion 24 and a bottom portion 26 along a vertical direction V. Thus, water heater 10 is generally vertically oriented. Water heater 10 can be leveled, e.g., such that casing 12 is plumb in the vertical direction V, in order to facilitate proper operation of water heater 10. A drain pan 28 is positioned at bottom portion 26 of water heater 10 such that water heater 10 sits on drain pan 28. Drain pan 28 sits beneath water heater 10 along the vertical direction V, e.g., to collect water that leaks from water heater 10 or water that condenses on an evaporator of water heater 10. It should be understood that water heater 10 is provided by way of example only and that the present subject matter may be used with any suitable water heater appliance.

Water heater 10 may further include a controller 30 that is configured for regulating operation of water heater appliance 100. Controller 30 may be in operative communication with various components of the water heater appliances, including, for example, components of a refrigeration system, temperature sensors, and a control panel 32. Control panel 32 may include various displays and input controls for user interface with the water heater 10. Controller 20 can, for example, selectively activate the refrigeration system to heat water within compartment 16.

Controller 30 includes memory and one or more processing devices such as microprocessors, CPUs or the like, such as general or special purpose microprocessors operable to execute programming instructions or micro-control code associated with operation of water heater 10. The memory can represent random access memory such as DRAM, or read only memory such as ROM or FLASH. The processor executes programming instructions stored in the memory. The memory can be a separate component from the processor or can be included onboard within the processor. Alternatively, controller 30 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
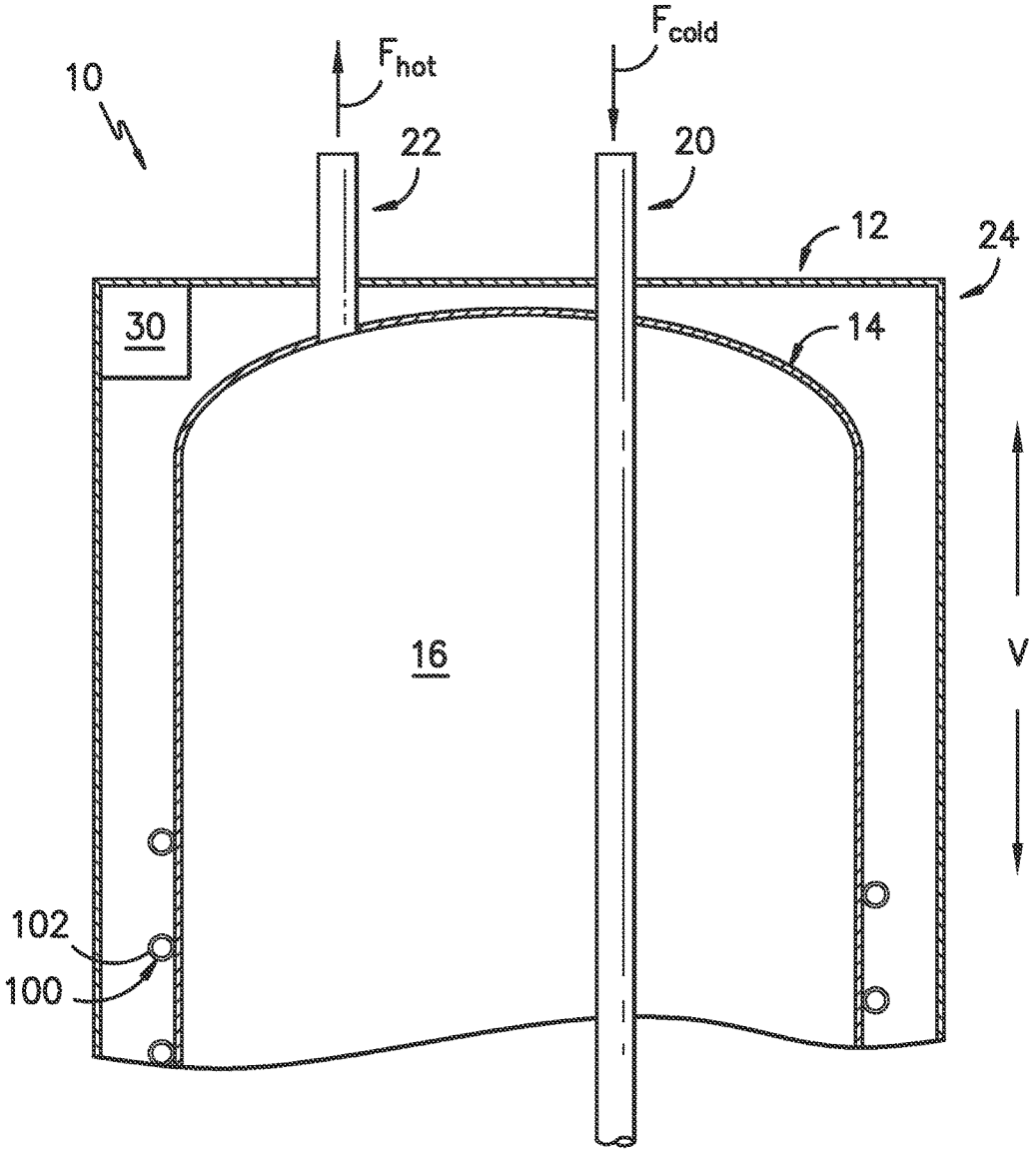
FIG. 2 provides a side cross-sectional view of an appliance (in this case a water heater) in accordance with one embodiment of the present disclosure.

As illustrated, appliance 10 may further include a refrigeration system 100. In general, refrigeration system 100 is charged with a refrigerant which is flowed through various components and which facilitates heating or cooling of compartment(s), such as the compartment 16 of the tank or housing 14, of the appliance 10. Refrigeration system 100 is thus generally in communication with the housing 14. For example, in the water heater 10 embodiment as illustrated in FIG. 2, condenser 102 of a refrigeration system 100 may wrap around the housing 14. Heat emitted from the condenser 102 may warm the water in compartment 16. In other embodiments, such as in a refrigerator, an evaporator of the refrigeration system 100 may be in communication with the compartment, and may provide cooled air to the compartment. For example, the cooled air may be flowed from the evaporator through ducts into the compartments to cool the compartments, as is generally understood.

It should be understood that the refrigeration system 100 includes a variety of conduits through which the refrigerant flows during operation. The conduits generally flow the refrigerant therethrough between and through the various other components of the refrigeration system. Accordingly, flow described as between two components is flowed between the two components through a conduit that extends therebetween.

Referring now to FIGS. 3 through 12, refrigeration systems 100 in accordance with the present disclosure are electrochemical refrigeration systems. As such, the compressor of a refrigeration system 100 in accordance with the present disclosure is an electrochemical compressor which includes one or more electrochemical cells therein. In general, and as discussed in detail herein, the cells are electrically connected to each other through a power supply, and each electrochemical cell includes an anode, a cathode, and an electrolyte disposed between and in electrical contact with the cathode and the anode. Further refrigeration systems 100 in accordance with the present disclosure include a refrigerant which includes a working fluid and an electrochemically active fluid. The working fluid may for example be water, ammonia, or another suitable polar liquid. The electrochemically active fluid takes part in the electrochemical process within the electrochemical cells. In exemplary embodiments, the electrochemically active fluid is hydrogen. Refrigeration systems 100 in accordance with the present disclosure further advantageously include various features which increase the efficiency of the systems and the predictability of the refrigerant performance during operation of the systems.

Figure 3:
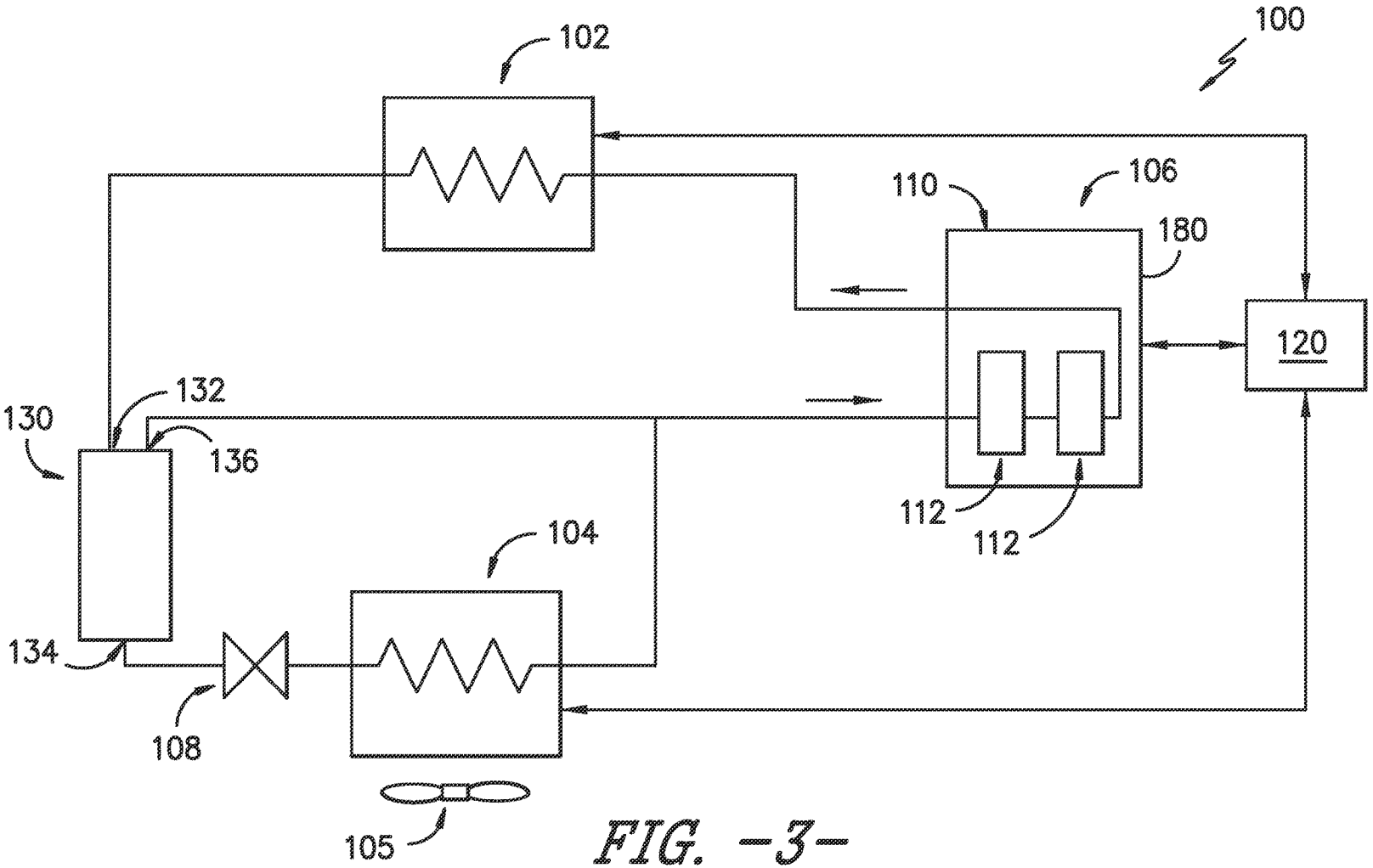
FIG. 3 is a schematic view of a refrigeration system in accordance with one embodiment of the present disclosure.

Referring now for example to FIG. 3, a refrigeration system in accordance with the present disclosure includes a condenser 102, an evaporator 104, and an electrochemical compressor 106. The condenser 102 may be disposed downstream (in the direction of flow of the refrigerant) of and in fluid communication (via suitable conduits) with the compressor 106. Thus, condenser 102 may receive refrigerant from the compressor 106, and may condense the refrigerant, as is generally understood, by lowering the temperature of the refrigerant flowing therethrough due to for example heat exchange with ambient air. Evaporator 104 is disposed downstream of and in fluid communication with the condenser 102. The evaporator 104 is generally a heat exchanger that transfers heat from air passing over the evaporator 104 to refrigerant flowing through the evaporator 104, thereby cooling the air and causing the refrigerant to vaporize. An evaporator fan 105 may be used to force air over the evaporator 104, as illustrated. As such, cooled air is produced and supplied to refrigerated compartments of an associated appliance 10. Compressor 106 is disposed downstream of and in fluid communication with the evaporator 104, and upstream of and in fluid communication with the condenser 102, thus completing a closed refrigeration loop or cycle. Compressor 106 generally compresses the refrigerant, as is generally understood, thus raising the temperature and pressure of the refrigerant.

Additionally, in exemplary embodiments as illustrated, an expansion device 108 may be included in the refrigeration system 100. Expansion device 108 may be utilized to expand the refrigerant, thus further reduce the pressure of the refrigerant, leaving condenser 102 before being flowed to evaporator 104. Expansion device 108 in exemplary embodiments is disposed downstream of condenser 104 and upstream of the evaporator 104. In exemplary embodiments expansion device 108 is a valve, such as a fixed orifice valve or automatic expansion valve. Alternatively, expansion device 108 may be a suitable sized capillary tube or other device suitable for facilitating expansion and pressure reduction.

Figure 4:
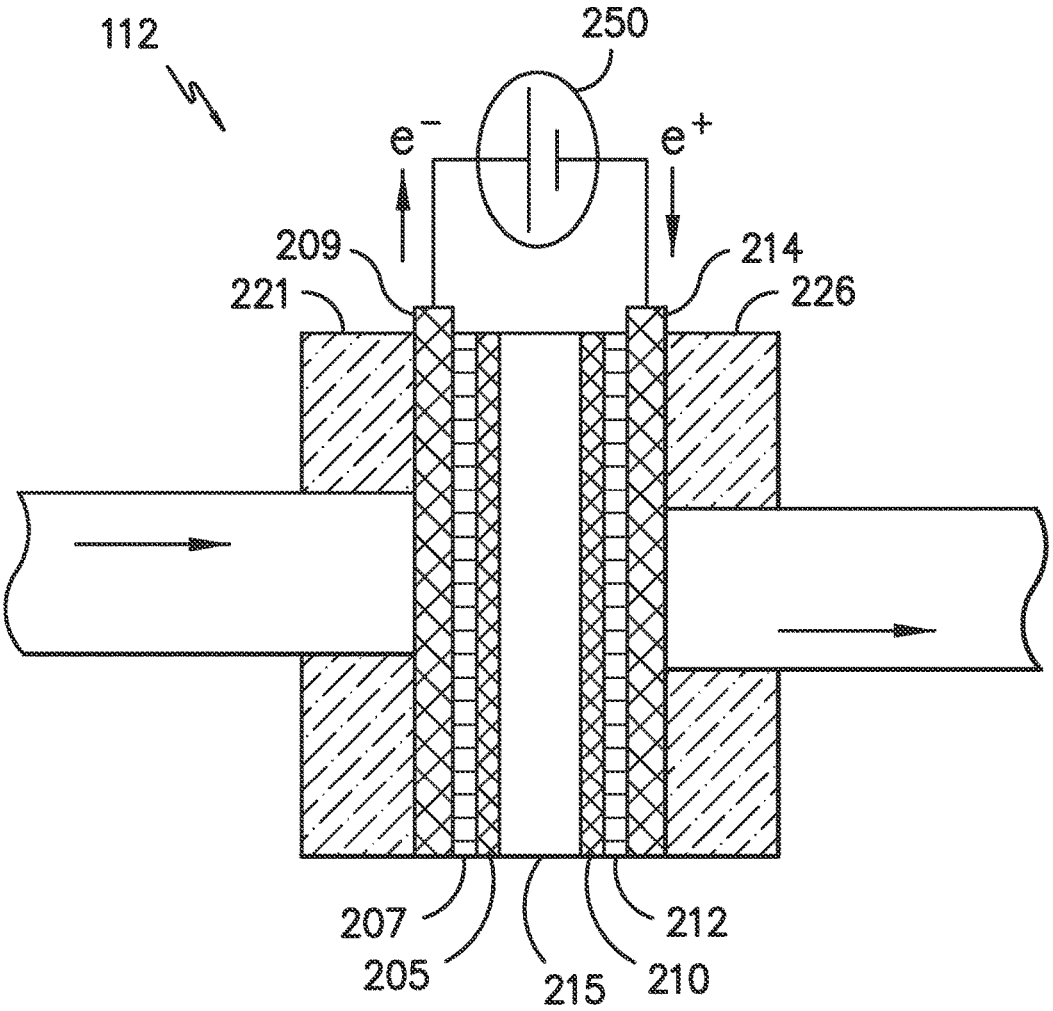
FIG. 4 is a schematic view of an electrochemical cell in accordance with one embodiment of the present disclosure.

As discussed, compressor 106 is an electrochemical compressor. Accordingly, compressor 106 includes a housing 110 and one or more electrochemical cells 112 disposed within the housing 110. FIG. 4 illustrates an exemplary electrochemical cell 112 in accordance with one embodiment of the present disclosure. Each cell 112 includes an anode 205, where the electrochemically active fluid of the refrigerant is oxidized; a cathode 210, where the electrochemically active fluid of the refrigerant is reduced; and an electrolyte 215 that serves to conduct the ionic species from the anode 205 to the cathode 210. The electrolyte 215 can be an impermeable solid ion exchange membrane having a porous microstructure and an ion exchange material impregnated through the membrane such that the electrolyte 215 can withstand an appreciable pressure gradient between its anode and cathode sides. The examples provided here employ impermeable ion exchange membranes. However, a permeable ion exchange membrane is also feasible with the refrigerant traversing in a unidirectional and sequential path through electrode assemblies with increasing pressure. The active components of the refrigerant dissolve into the ion exchange media of the ion exchange membrane and the gas in the refrigerant traverses through the ion exchange membrane.

As another example, the electrolyte 215 can be made of a solid electrolyte, for example, a gel, that is, any solid, jelly-like material that can have properties ranging from soft and weak to hard and tough and being defined as a substantially dilute crosslinked system that exhibits no flow when in the steady-state. The solid electrolyte can be made very thin, for example, it can have a thickness of less than 0.2 mm, to provide additional strength to the gel. Alternatively, the solid electrolyte can have a thickness of less than 0.2 mm if it is reinforced with one or more reinforcing layers like a polytetrafluoroethylene (PTFE) membrane (having a thickness of about 0.04 mm or less) depending on the application and the ion exchange media of the electrolyte.

Each of the anode 205 and the cathode 210 can be an electrocatalyst such as platinum or palladium or any other suitable candidate catalyst. The electrolyte 215 can be a solid polymer electrolyte such as Nafion (trademark for an ion exchange membrane manufactured by the I. E. DuPont DeNemours Company) or GoreSelect (trademark for a composite ion exchange membrane manufactured by W. L. Gore & Associates Inc.). The catalysts (that is, the anode 205 and the cathode 210) are intimately bonded to and in electrical contact with each side of the electrolyte 215. An anode gas space (a gas diffusion media) 207 is defined on the nonelectrolyte side of the anode 205 and a cathode gas space (a gas diffusion media) 212 is defined on the nonelectrolyte side of the cathode 210. The electrodes (the anode 205 and the cathode 210) of the cell 112 can be considered as the electrocatalytic structure that is bonded to the solid electrolyte 215. The combination of the electrolyte 215 (which can be an ion exchange membrane) and the electrodes (the anode 205 and the cathode 210) is referred to as a membrane electrode assembly or MEA.

Adjacent the anode gas space 207 is an anode current collector 209 and adjacent the cathode gas space 212 is a cathode current collector 214. The anode collector 209 and the cathode collector 214 are electrically driven by a power supply 250. Power supply 250 is, for example, a battery, a rectifier, or other electric source that supplies a direct current electric power to the compressor 112. The anode collector 209 and the cathode collector 214 are porous, electronically conductive structures that can be woven metal screens or woven carbon cloth or pressed carbon fiber or variations thereof. The pores in the current collectors 209, 214 serve to facilitate the flow of gases within the gas spaces 207, 212 adjacent to the respective electrodes 205, 210.

Outer surfaces of the collectors 209, 214 are connected to respective bipolar plates 221, 226 that provide fluid barriers that retain the gases within the cell 202. Additionally, if the cell 202 is provided in a stack of cells, then the bipolar plates 221, 226 separate the anode and cathode gases within each of the adjacent cells in the cell stack from each other and facilitate the conduction of electricity from one cell to the next cell in the cell stack of the compressor.

Figure 5:
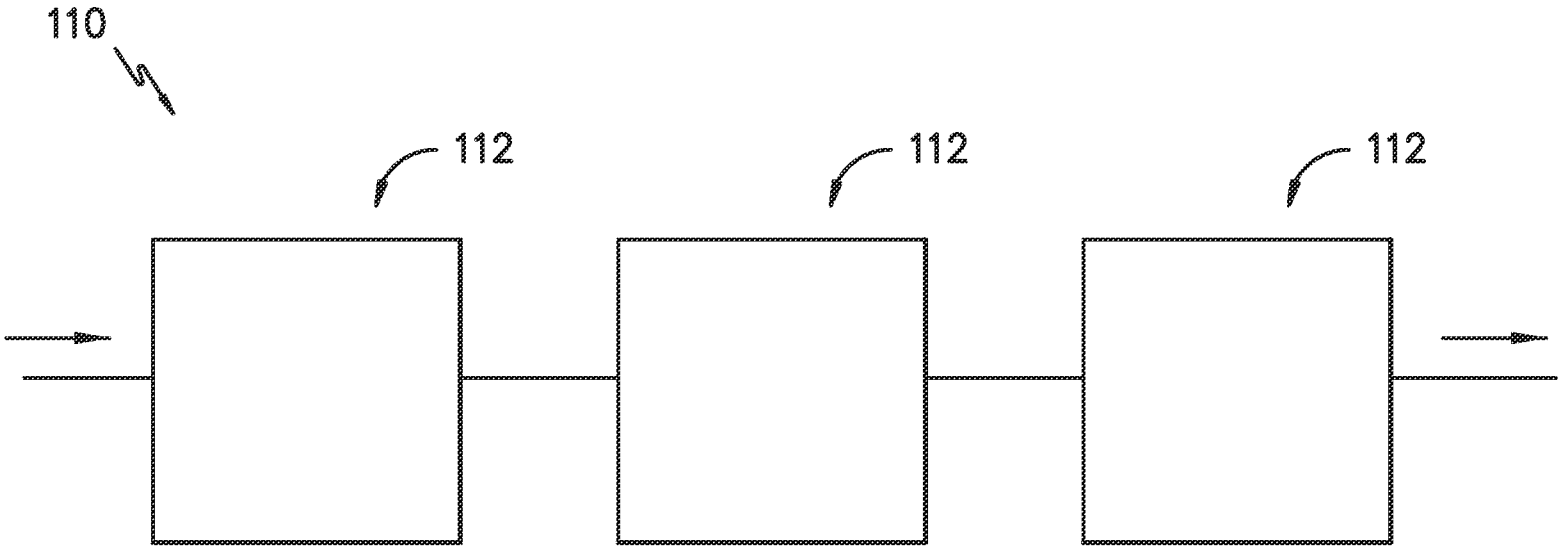
FIG. 5 is a schematic view of a plurality of electrochemical cells in series in accordance with one embodiment of the present disclosure.

FIG. 5 illustrates a plurality of electrochemical cells 112. In the embodiment shown, the cells 112 are connected in series. In alternative embodiments a plurality of electrochemical cells 112 may be provided in parallel, or various of a plurality of electrochemical cells 112 may be provided in series and parallel.

Referring again to FIG. 4, refrigeration system 100 may include a controller 120. When refrigeration system 100 is incorporated into an appliance 10, the controller 120 may be controller 30 or a component of controller 30, or controller 120 may be separate from controller 30. Controller 120 may include one or more memory devices and one or more microprocessors, such as a general or special purpose microprocessor operable to execute programming instructions or micro-control code associated with the operation of the refrigeration system 100. The memory may represent random access memory such as DRAM, or read only memory such as ROM or FLASH. In one embodiment, the processor executes programming instructions stored in memory. The memory may be a separate component from the processor or may be included onboard within the processor. The controller may include one or more proportional-integral (PI) controllers programmed, equipped, or configured to operate the refrigeration system according to exemplary aspects of the control methods set forth herein. Accordingly, as used herein, "controller" includes the singular and plural forms.

As illustrated, controller 120 may be in communication with the compressor 106, as well as with the condenser 102 and evaporator 104 (and thus the fan 105 thereof). Controller 120 may thus control operation of the various components of the refrigeration system 100 and operation of the refrigeration system 100 in general.

Figure 6:
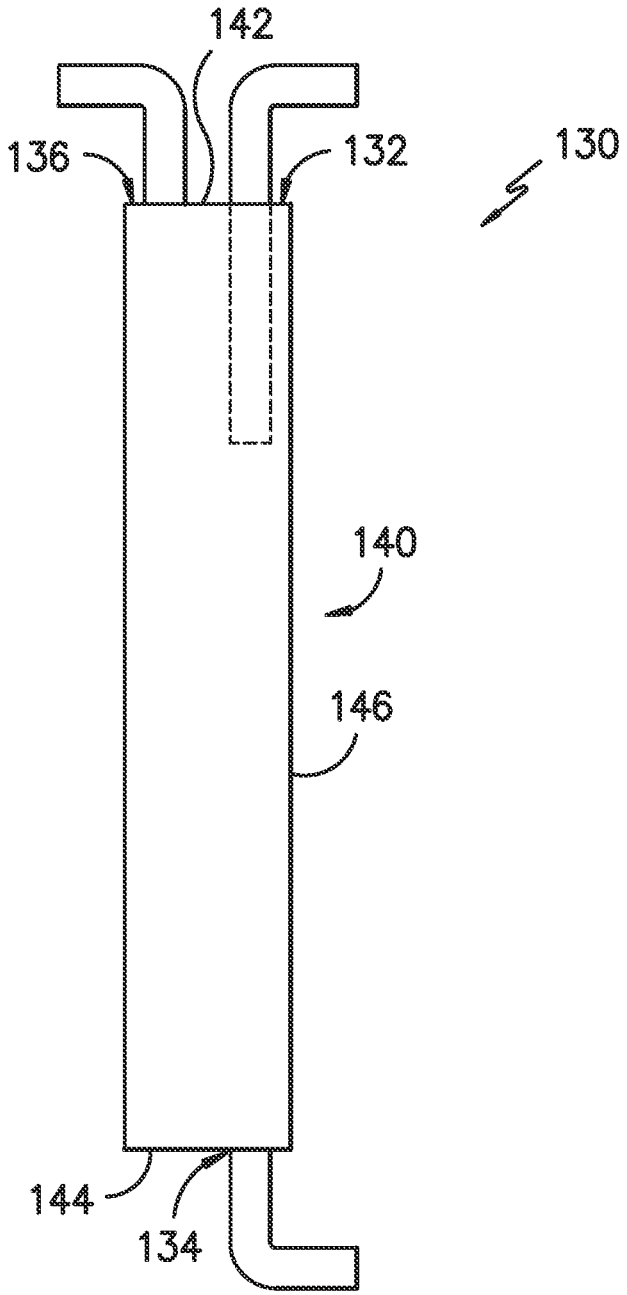
FIG. 6 is a front cross-sectional view of a phase separator in accordance with one embodiment of the present disclosure.

Referring again to FIG. 3 as well as to FIG. 6, in some embodiments, system 100 may further include a phase separator 130. A phase separator 130 in accordance with the present disclosure generally separates different phases of fluid flowed therethrough. For example, gaseous fluid and liquid fluid may be separated within a phase separator 130. As illustrated, phase separator 130 may be in fluid communication with the condenser 102 and the evaporator 104. For example, phase separator 130 may be downstream of the condenser 102. Additionally, phase separator 130 may be upstream of the evaporator 104 and expansion device 108 (with respect to one of the outlets of the phase separator 130, as discussed herein). Thus, for example, expansion device 108 may be disposed between and in fluid communication with the phase separator 130 and the evaporator 104.

As shown, phase separator 130 includes an inlet 132, a first outlet 134 and a second outlet 136. The inlet 132 generally accepts refrigerant from the condenser 102. As generally understood, the refrigerant flowing into the inlet 132 from the condenser 102 may include a gaseous component and a liquid component. Specifically, the electrochemically active fluid may be in gaseous form, and the working fluid may be in liquid form. If the gaseous portion of the refrigerant was allowed to flow through the expansion device 108 and the evaporator 104, performance of both components could be adversely affected, decreasing the performance of the refrigeration system 100 generally. Accordingly, phase separator 130 allows the gaseous portion of the refrigerant to bypass the expansion device 108 and the evaporator 104. For example, the first outlet 134 is configured to exhaust the liquid portion of the refrigerant, including the working fluid, while the second outlet 136 is configured to exhaust the gaseous portion of the refrigerant, including the electrochemically active fluid.

As shown in FIG. 6, in exemplary embodiments, phase separator 130 includes a vessel 140 which includes and extends between a top surface 142 and a bottom surface 144. One or more side surfaces 146 may separate the top surface 142 and bottom surface 144 and further define the vessel 140. The first outlet 134 may, for example, be defined in the bottom surface 144. The second outlet 136 may, for example, be defined in the top surface 142. Inlet 132 may additionally, for example, be defined in the top surface 142 as shown. Such design may facilitate separation of the liquid and gaseous portions of the refrigerant, by allowing the liquid to fall through the first outlet 134 while the gas rises through the second outlet 136. It should be understood, however, that phase separators 130 in accordance with the present disclosure are not limited to the above disclosed embodiments and rather that any suitable components operable to facilitate separation of the various phases of refrigerant are within the scope and spirit of the present disclosure.

Accordingly, phase separator 130 facilitates separation of the working fluid from the electrochemically active fluid after the refrigerant flows through the condenser 102. As illustrated, the working fluid exhausted from the first outlet 134 is flowed through the expansion device 108 and evaporator 104. The electrochemically active fluid exhausted from the second outlet 136 bypasses the expansion device 108 and the evaporator 104. Accordingly, performance of the expansion device 108 and the evaporator 104, and the refrigeration system 100 generally, is advantageously increased.

The refrigerant, such as the electrochemically active fluid, exhausted from the second outlet 136 may further, after bypassing the expansion device 108 and evaporator 104, be combined with the refrigerant, such as the working fluid, that is exhausted from the first outlet 134 downstream of the evaporator 104 after that refrigerant has flowed through the evaporator 104. Additionally, as shown, in exemplary embodiments, such combination may be upstream of and external to the compressor 106. For example, the conduit through which the refrigerant, such as the electrochemically active fluid, flows after exhaustion from the second outlet 136 and the conduit through which the refrigerant, such as the working fluid, flows after flowing through the evaporator 104 may tee together such that the fluids flowing therethrough are combined. The conduits may advantageously be suitable sized such that the fluids are at appropriate pressures for further flow through the compressor 106, etc.

Figure 7:
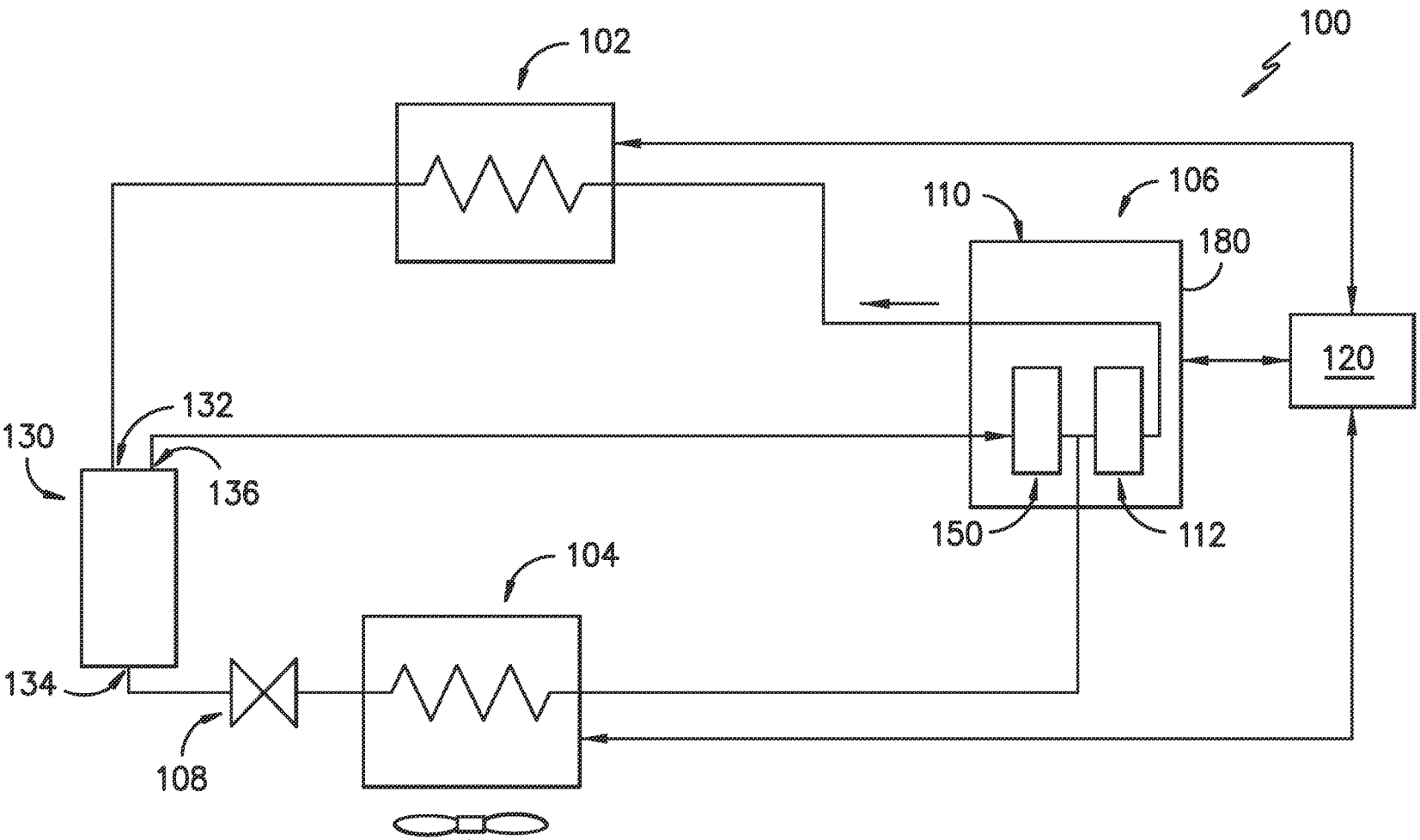
FIG. 7 is a schematic view of a refrigeration system in accordance with another embodiment of the present disclosure.
Figure 8:
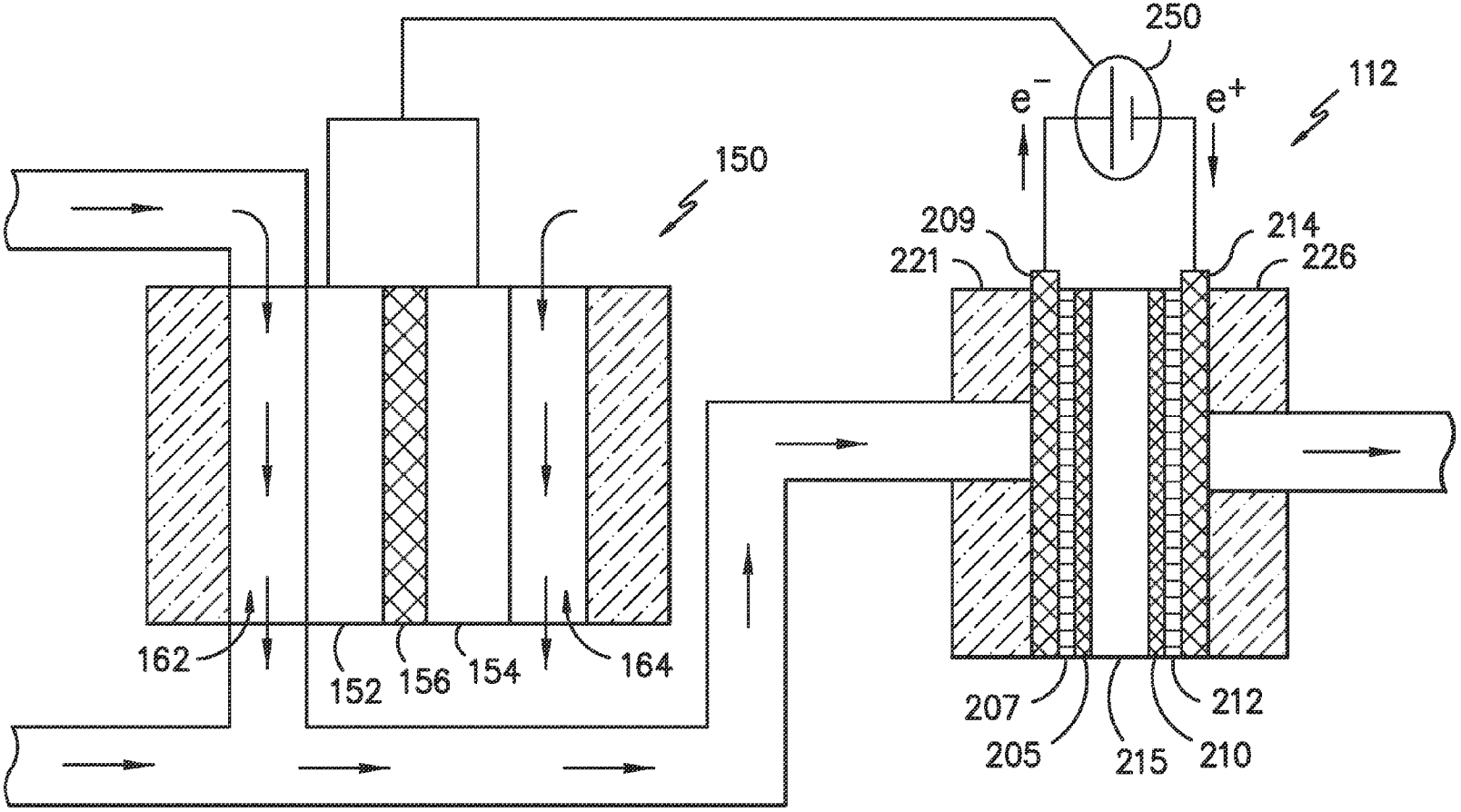
FIG. 8 is a schematic view of an energy recovery cell in series with an electrochemical cell in accordance with one embodiment of the present disclosure.

Referring now to FIGS. 7 and 8, in some embodiments, refrigeration system 100 can further include an energy recover cell 150. The energy recovery cell 150 can advantageously be utilized to recover energy from the refrigerant, and specifically the electrochemically active fluid thereof, during operation. For example, electricity can be generated by the energy recovery cell 150. The energy recovery cell 150 can be in electrical communication with the electrochemical cells 112, such that the generated electricity can be provided to the power supply 250. Accordingly, use of an energy recovery cell 150 can increase the efficiency and lower the power demands of the refrigeration system 100 generally.

In exemplary embodiments as shown, the electrochemically active fluid exhausted from the second outlet 136 of the phase separator 130 is in fluid communication with the energy recovery cell 150, and thus flows through the energy recovery cell 150. As discussed herein, this flow of the electrochemically active fluid through energy recovery cell 150 generates electricity, which can be provided to the power supply 250.

The electrochemically active fluid in these embodiments may be combined with the working fluid exhausted from the first outlet 134 downstream of the energy recovery cell 150. Such working fluid may, for example, have further flowed through the expansion device 108 and the evaporator 104. As illustrated, in exemplary embodiments, energy recovery cell 150 is disposed within the housing 110 of the compressor 106. Additionally or alternatively, the energy recovery cell 150 may be disposed upstream of the electrochemical cells 112. The electrochemically active fluid thus can flow, for example, from the phase separator 130 through the energy recovery cell 150 and combine with the working fluid downstream of the energy recovery cell 150 and upstream of the electrochemical cells 112.

As illustrated in FIG. 8, and similar to an electrochemical cell 112, energy recovery cell 150 can include an anode 152, a cathode 154 and an electrolyte 156 disposed between and in electrical contact with the anode 152 and the cathode 154. The electrolyte 156 of the energy recovery cell 150 can, in exemplary embodiments, be formed from a woven polymer material. The anode 152 may include a plate formed from a suitable metal, such as in exemplary embodiments platinum, and the cathode 152 may include a plate formed from a suitable metal, such as in exemplary embodiments platinum. An anode gas space 162 is defined on the nonelectrolyte side of the anode 152 and a cathode gas space 164 is defined on the nonelectrolyte side of the cathode 154. As discussed, electrochemically active fluid flows past one of the anode 152 or cathode 154, such as past the anode 152 in the anode gas space 162. Another suitable fluid, such as a suitable gas such as air or oxygen, may flow past the other of the anode 152 or cathode 154, such as past the cathode 154 in the cathode gas space 164. The interaction between the fluids and the anode 152, cathode 154 and electrolyte 156 within the energy recovery cell 150 may generate electricity, as illustrated. Further, as shown, the energy recovery cell 150 may be in electrical communication with the power supply 250, and this generated electricity may be provided to the power supply 250.

Figure 9:
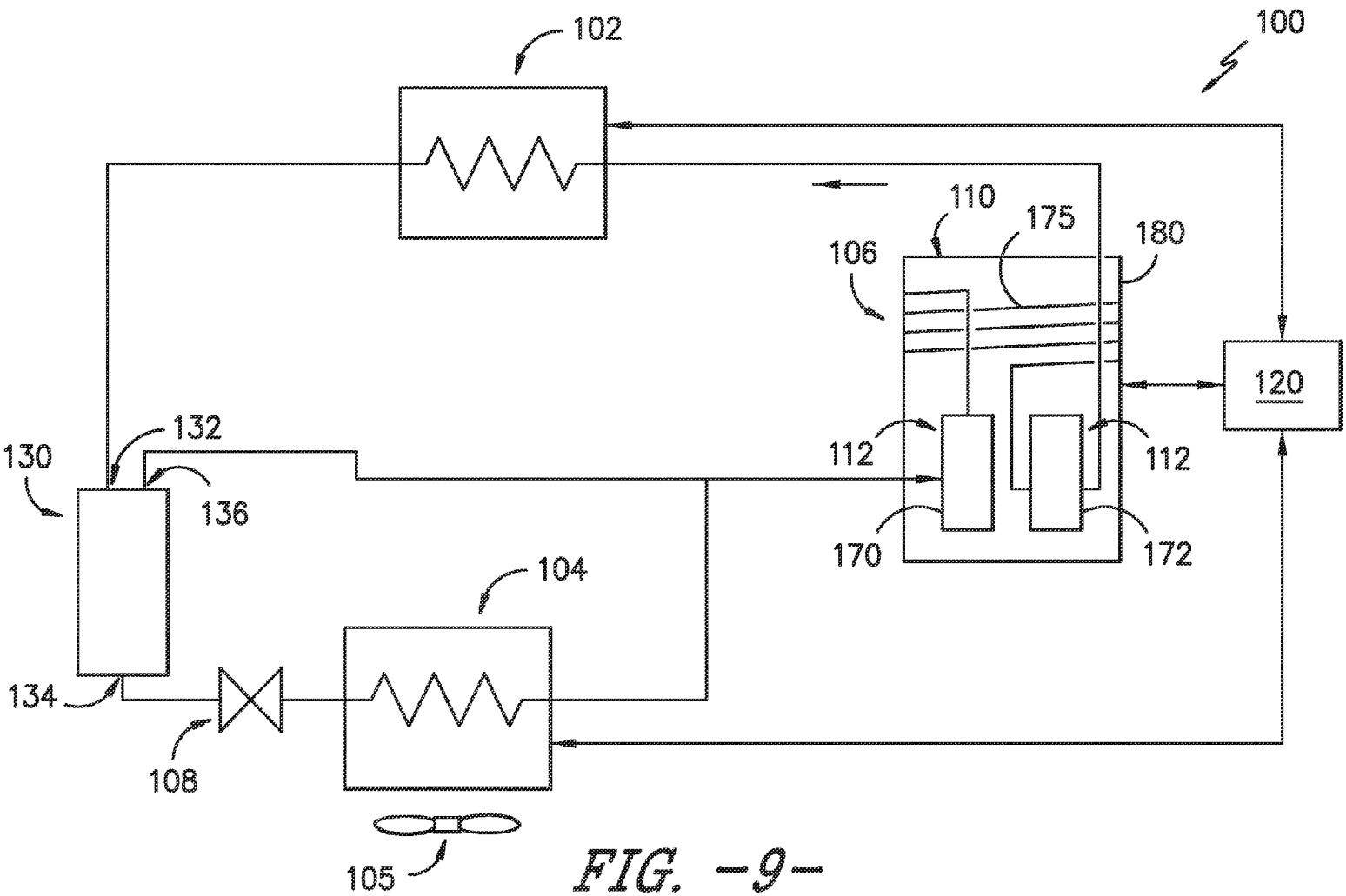
FIG. 9 is a schematic view of a refrigeration system in accordance with another embodiment of the present disclosure.
Figure 10:
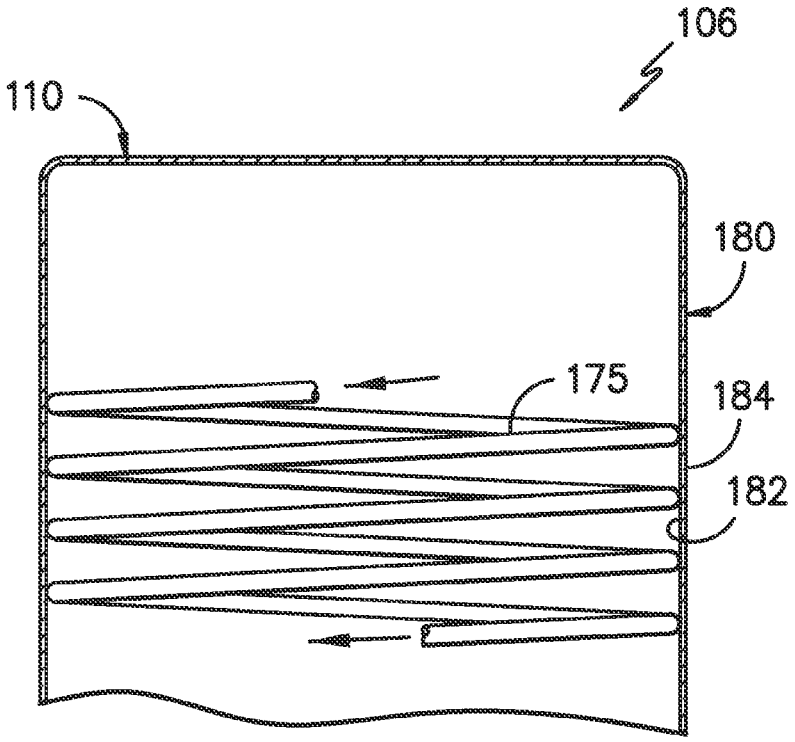
FIG. 10 is a side cross-sectional view of a portion of an electrochemical compressor in accordance with one embodiment of the present disclosure.
Figure 11:
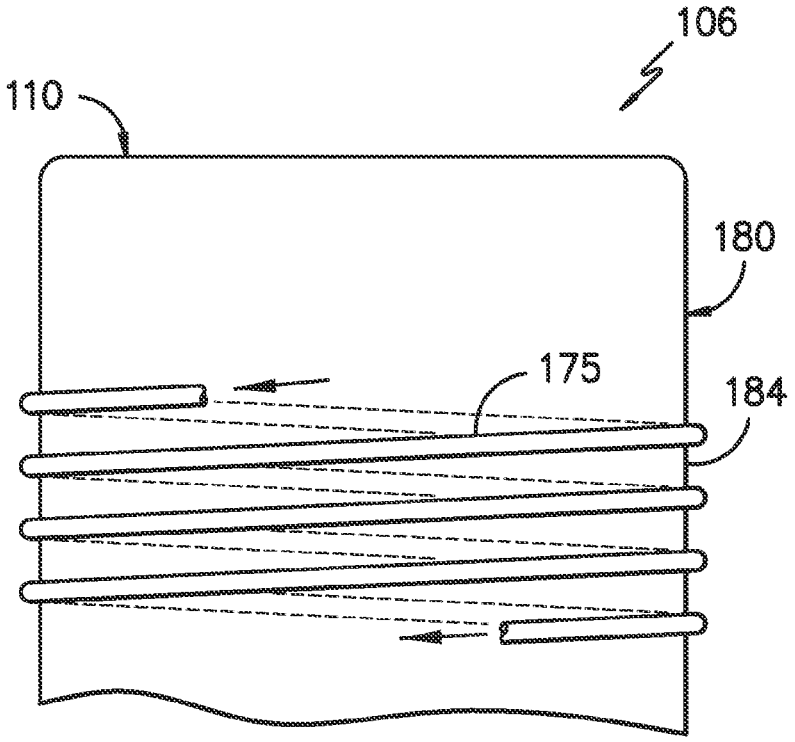
FIG. 11 is a side cross-sectional view of a portion of an electrochemical compressor in accordance with another embodiment of the present disclosure.

Referring now to FIGS. 9 through 11, in some embodiments, conduits that extends between and are in fluid communication with neighboring electrochemical cells 112 within compressor 106 may be routed to emit heat and reduce the temperature of the refrigerant between the neighboring cells 112. This reduction in temperature of the refrigerant between the cells 112 can advantageously reduce the energy consumption of and increase the efficiency of the cells 112, compressor 106, and system 100 generally. As illustrated, a plurality of electrochemical cells 112 may include a first cell 170 and a second cell 172 downstream of the first cell 170. It should be understood that the first and second cells 170, 172 may be any two neighboring cells 112 of a plurality of cells 112 within compressor 106. A third cell, fourth cell, etc. may additionally be included. The cells 112 may be aligned and in fluid communication in series as shown. Conduits 175 may extend between and be in fluid communication with neighboring cells 112, such as the first cell 170 and second cell 172. Further, as illustrated, at least a portion of a conduit 175 extending between neighboring cells 112 such as the first cell 170 and second cell 172 may extend peripherally about and proximate to the housing 110. Refrigerant may flow from the first cell 170 through the conduit 175 to the second cell 172.

Housing 110 may include one or more sidewalls 180 which have an inner surface 182 and an outer surface 184. The sidewall(s) 180 may define the periphery of the housing 110. The portion of the conduit 175 that extends peripherally about and proximate the housing 110 may allow heat to be dissipated from refrigerant as it flows therethrough. This portion of the conduit 175 may extend partially or fully about the periphery of the housing 110 one or more times to allow heat dissipation. For example, in some embodiments this portion of the conduit 175 may wrap generally helically about the periphery of the housing 110.

In some embodiments as illustrated in FIG. 10, the conduit 175, such as the portion of the conduit 175 that extends peripherally about and proximate the housing 110, may contact the inner surface 182 of the housing 110 and thus be disposed within the housing 110. Accordingly, in these embodiments, the portion of the conduit 175 may be within the housing 110. In other embodiments wherein the portion of the conduit 175 is within the housing 110, it may be slightly spaced from and thus proximate to but not in contact with the housing 110. In other embodiments as illustrated in FIG. 11, the conduit 175, such as the portion of the conduit 175 that extends peripherally about and proximate the housing 110, may contact the outer surface 184 of the housing 110 and thus be disposed within the housing 110. Accordingly, in these embodiments, the portion of the conduit 175 may be exterior to the housing 110. In other embodiments wherein the portion of the conduit 175 is exterior to the housing 110, it may be slightly spaced from and thus proximate to but not in contact with the housing 110.

Figure 12:
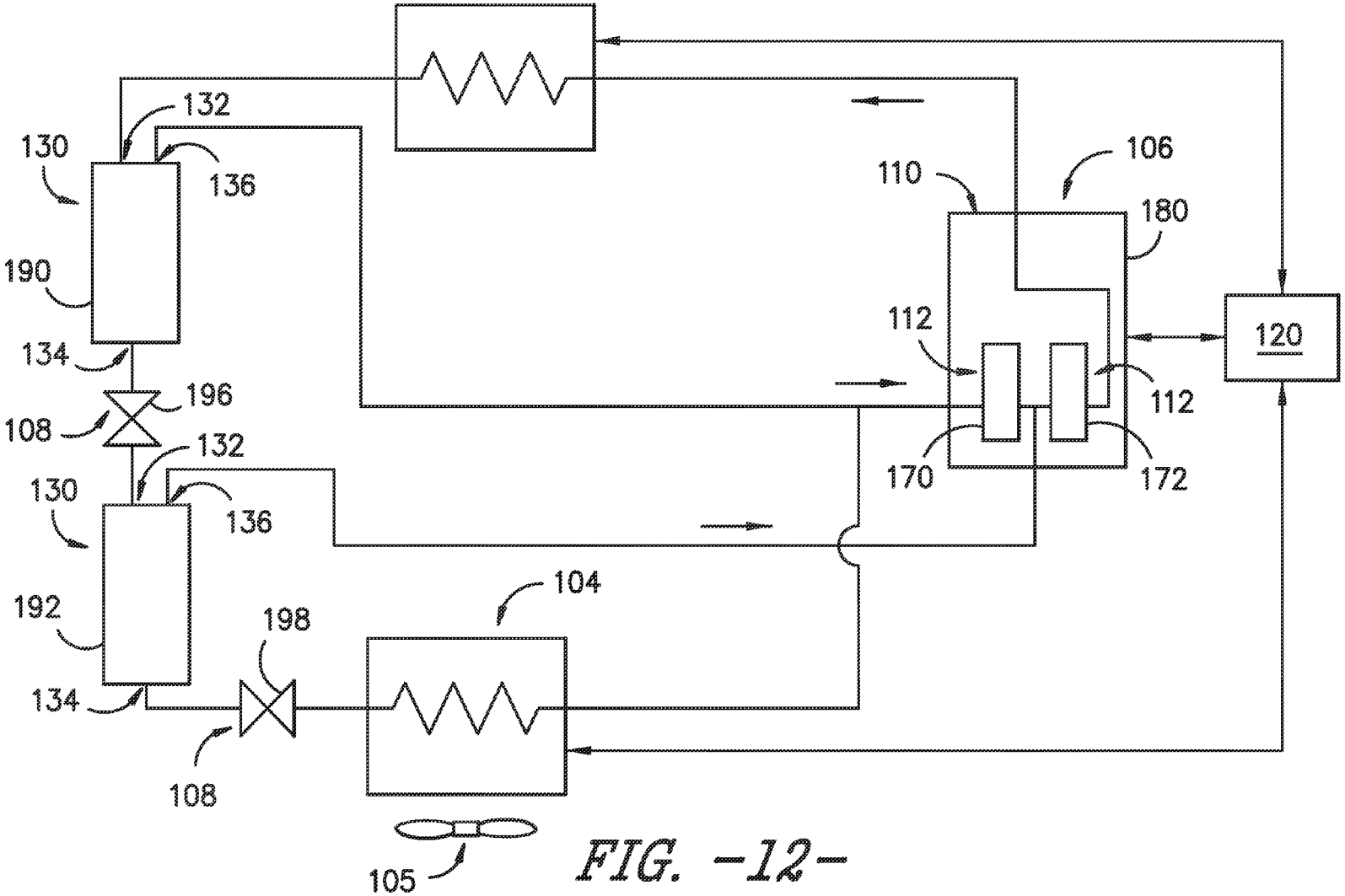
FIG. 12 is a schematic view of a refrigeration system in accordance with another embodiment of the present disclosure.

Referring now to FIG. 12, in some embodiments, additional components may be utilized within system 100 to reduce the energy consumption of the compressor 106 and thus the system 100 generally during operation. For example, system 100 may include a plurality of phase separators 130, such as a first phase separator 190 and a second phase separator 192. System 100 may further include a plurality of expansion devices 108, such as a first expansion device 196 and a second expansion device 198. For example, first expansion device 196 may be disposed between the first phase separator 190 and the second phase separator 192 (along the flow of refrigerant from the first outlet 134 of the first phase separator 190), and second expansion device 198 may be disposed between the second phase separator 192 and the evaporator 104 (along the flow of refrigerant from the first outlet 134 of the second phase separator 192). The phase separators 190, 192, as well as the expansion devices 196, 198, may be arranged within the system to further reduce the energy consumption of the compressor 106.

For example, as discussed herein, the first phase separator 190 may be in fluid communication with and disposed downstream of the condenser 102. First phase separator 190, such as the first outlet 134 thereof, may further be in fluid communication with and disposed upstream of the first expansion device 196. Inlet 132 may receive refrigerant from the condenser 102. First outlet 134 may exhaust a liquid portion of the refrigerant, such as the working fluid, while second outlet 136 exhausts a gaseous portion of the refrigerant, such as the electrochemically active fluid. As illustrated, the electrochemically active fluid exhausted from the second outlet 136 bypasses the evaporator 104.

The second phase separator 192 may be in fluid communication with and disposed downstream of the first outlet 134 of the first phase separator 190, as well the first expansion device 196. Second phase separator 192, such as the first outlet 134 thereof, may further be in fluid communication with and disposed upstream of the second expansion device 196. Inlet 132 may receive refrigerant, such as working fluid, from the first outlet 134 of the first phase separator 192, as well as the first expansion device 196. Notably, this refrigerant may include a liquid portion and a gaseous portion. Similar to the electrochemically active fluid separated by the first phase separator 190, if the gaseous portion of the refrigerant was allowed to flow through the second expansion device 198 and the evaporator 104, performance of both components could be adversely affected, decreasing the performance of the refrigeration system 100 generally. Accordingly, second phase separator 192 allows the gaseous portion of the refrigerant to bypass the second expansion device 198 and the evaporator 104. For example, the first outlet 134 is configured to exhaust the liquid portion of the refrigerant, including the working fluid, while the second outlet 136 is configured to exhaust the gaseous portion of the refrigerant, including the working fluid.

Accordingly, second phase separator 192 facilitates separation of the liquid portion of the working fluid from the gaseous portion of the working fluid after the refrigerant flows through the first phase separator 190, as well as the first expansion device 196. As illustrated, the liquid portion of the working fluid exhausted from the first outlet 134 of the second phase separator 192 is flowed through the second expansion device 198 and evaporator 104. The gaseous portion of the working fluid exhausted from the second outlet 136 of the second phase separator 192 bypasses the second expansion device 198 and the evaporator 104. Accordingly, performance of the expansion device 198 and the evaporator 104, and the refrigeration system 100 generally, is advantageously increased.

As discussed herein, the refrigerant, such as the electrochemically active fluid, exhausted from the second outlet 136 of the first phase separator 190 may after bypassing the expansion devices 196, 198, second phase separator 190 and evaporator 104 be combined with the refrigerant, such as the working fluid, exhausted from the first outlet 134 of the second phase separator 192 downstream of the evaporator 104 after that refrigerant has flowed through the evaporator 104. Additionally, as shown, in exemplary embodiments, such combination may be upstream of and external to the compressor 106. For example, the conduit through which the refrigerant, such as the electrochemically active fluid, flows after exhaustion from the second outlet 136 and the conduit through which the refrigerant, such as the working fluid, flows after flowing through the evaporator 104 may tee together such that the fluids flowing therethrough are combined. The conduits may advantageously be suitable sized such that the fluids are at appropriate pressures for further flow through the compressor 106, etc.

Further, and advantageously, the refrigerant, such as the working fluid, exhausted from the second outlet 136 of the second phase separator 192 may bypass one or more electrochemical cells 112. For example, as shown, the refrigerant, such as the working fluid, exhausted from the second outlet 136 of the second phase separator 192 may bypass the first electrochemical cell 170. This refrigerant may then be combined with the refrigerant, such as the working fluid exhausted from the first outlet 134 of the second phase separator 192 (as well as the refrigerant, such as the electrochemically active fluid, combined with this refrigerant) between various of the cells 112, such as between the first electrochemical cell 170 and the second electrochemical cell 172. Bypassing one or more cells 112 may further advantageously reduce the energy consumption of those cells 112, the compressor 106 generally, and the system 100 generally.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigeration system, comprising:

a refrigerant, the refrigerant comprising a working fluid and an electrochemically active fluid;

a condenser;

an evaporator;

an electrochemical compressor in fluid communication with the condenser and the evaporator, the electrochemical compressor comprising a housing, a first electrochemical cell disposed within the housing, and a second electrochemical cell disposed within the housing;

a first phase separator in fluid communication with and disposed downstream of the condenser, the first phase separator comprising an inlet, a first outlet and a second outlet, the first outlet configured to exhaust the working fluid, the second outlet configured to exhaust the electrochemically active fluid, wherein the electrochemically active fluid exhausted from the second outlet bypasses the evaporator; and a second phase separator in fluid communication with and disposed downstream of the first outlet of the first phase separator, the second phase separator comprising an inlet, a first outlet and a second outlet, the first outlet configured to exhaust a liquid portion of the working fluid, the second outlet configured to exhaust a gaseous portion of the working fluid, wherein the gaseous portion exhausted from the second outlet bypasses the evaporator; and wherein the working fluid exhausted from the first outlet of the second phase separator is flowed through the evaporator.

2. The refrigeration system of claim 1, wherein the working fluid is water.

3. The refrigeration system of claim 1, wherein the electrochemically active fluid is hydrogen.

4. The refrigeration system of claim 1, wherein the electrochemically active fluid exhausted from the second outlet of the first phase separator is combined with the working fluid exhausted from the first outlet of the second phase separator downstream of the evaporator.

5. The refrigeration system of claim 4, wherein the electrochemically active fluid exhausted from the second outlet of the first phase separator is combined with the working fluid exhausted from the first outlet of the second phase separator upstream of the electrochemical compressor.

6. The refrigeration system of claim 1, wherein the working fluid exhausted from the second outlet of the second phase separator bypasses the first electrochemical cell.

7. The refrigeration system of claim 6, wherein the working fluid exhausted from the second outlet of the second phase separator is combined with the working fluid exhausted from the first outlet of the second phase separator between the first electrochemical cell and the second electrochemical cell.

8. The refrigeration system of claim 1, wherein the first phase separator and the second phase separator each comprise a vessel extending between a top surface and a bottom surface, wherein the first outlet of the first phase separator is defined in the top surface of the first phase separator and the second outlet of the first phase separator is defined in the bottom surface of the first phase separator, and wherein the first outlet of the second phase separator is defined in the top surface of the second phase separator and the second outlet of the second phase separator is defined in the bottom surface of the second phase separator.

9. The refrigeration system of claim 1, further comprising a first expansion device disposed between the first phase separator and second phase separator and a second expansion device disposed between the second phase separator and the evaporator.

10. The refrigeration system of claim 1, wherein the first electrochemical cell and the second electrochemical cell each comprise an anode, a cathode, and an electrolyte disposed between and in electrical contact with the anode and the cathode.

11. An appliance, comprising:

a housing defining a compartment; and a refrigeration system in communication with the compartment for cooling the chamber, the refrigeration system comprising:

a refrigerant, the refrigerant comprising a working fluid and an electrochemically active fluid;

a condenser;

an evaporator;

an electrochemical compressor in fluid communication with the condenser and the evaporator, the electrochemical compressor comprising a housing, a first electrochemical cell disposed within the housing, and a second electrochemical cell disposed within the housing;

a first phase separator in fluid communication with and disposed downstream of the condenser, the first phase separator comprising an inlet, a first outlet and a second outlet, the first outlet configured to exhaust the working fluid, the second outlet configured to exhaust the electrochemically active fluid, wherein the electrochemically active fluid exhausted from the second outlet bypasses the evaporator; and a second phase separator in fluid communication with and disposed downstream of the first outlet of the first phase separator, the second phase separator comprising an inlet, a first outlet and a second outlet, the first outlet configured to exhaust a liquid portion of the working fluid, the second outlet configured to exhaust a gaseous portion of the working fluid, wherein the gaseous portion exhausted from the second outlet bypasses the evaporator; and wherein the working fluid exhausted from the first outlet of the second phase separator is flowed through the evaporator.

12. The appliance of claim 11, wherein the working fluid is water.

13. The appliance of claim 11, wherein the electrochemically active fluid is hydrogen.

14. The appliance of claim 11, wherein the electrochemically active fluid exhausted from the second outlet of the first phase separator is combined with the working fluid exhausted from the first outlet of the second phase separator downstream of the evaporator.

15. The appliance of claim 14, wherein the electrochemically active fluid exhausted from the second outlet of the first phase separator is combined with the working fluid exhausted from the first outlet of the second phase separator upstream of the electrochemical compressor.

16. The appliance of claim 11, wherein the working fluid exhausted from the second outlet of the second phase separator bypasses the first electrochemical cell.

17. The appliance of claim 16, wherein the working fluid exhausted from the second outlet of the second phase separator is combined with the working fluid exhausted from the first outlet of the second phase separator between the first electrochemical cell and the second electrochemical cell.

18. The appliance of claim 11, wherein the first phase separator and the second phase separator each comprise a vessel extending between a top surface and a bottom surface, wherein the first outlet of the first phase separator is defined in the top surface of the first phase separator and the second outlet of the first phase separator is defined in the bottom surface of the first phase separator, and wherein the first outlet of the second phase separator is defined in the top surface of the second phase separator and the second outlet of the second phase separator is defined in the bottom surface of the second phase separator.

19. The appliance of claim 11, wherein the refrigeration system further comprises a first expansion device disposed between the first phase separator and second phase separator and a second expansion device disposed between the second phase separator and the evaporator.

20. The appliance of claim 11, wherein the first electrochemical cell and the second electrochemical cell each comprise anode, a cathode, and an electrolyte disposed between and in electrical contact with the anode and the cathode.

* * * * *